United States Patent [19]

Lehman

[11] Patent Number: 4,497,088

[45] Date of Patent: Feb. 5, 1985

[54] GROUND COTTON RETRIEVER WITH DUAL CLEANING MEANS

[75] Inventor: Lawrence A. Lehman, Buckeye, Ariz.

[73] Assignee: Ultra Harvesters, Inc., Phoenix, Ariz.

[21] Appl. No.: 566,046

[22] Filed: Dec. 27, 1983

[51] Int. Cl.[3] ..... D01B 3/00; D01B 1/08

[52] U.S. Cl. ..... 19/202; 19/203; 19/57

[58] Field of Search ..... 19/202, 203, 93, 95, 19/57, 58, 60, 55 R, 53, 80 R, 80 A; 56/28, 48, 49, 364

[56] References Cited

U.S. PATENT DOCUMENTS

| | | | |
|---|---|---|---|
| 1,751,306 | 3/1930 | Cumpston | 19/57 |
| 1,751,307 | 3/1930 | Cumpston | 19/57 |
| 1,751,308 | 3/1930 | Cumpston | 19/57 |
| 2,776,454 | 1/1957 | Dyson | 19/57 X |
| 2,827,667 | 3/1958 | Moss | 19/203 |
| 2,948,022 | 8/1960 | Day | 19/203 |
| 3,046,612 | 7/1962 | Kyame et al. | 19/203 |
| 3,086,254 | 4/1963 | Mitchell et al. | 19/203 |
| 3,217,878 | 11/1965 | Rood, Jr. et al. | 209/78 |
| 3,302,247 | 2/1962 | Rood, Jr. | 19/48 |
| 3,305,898 | 2/1967 | Rood, Jr. | 19/203 |
| 3,342,310 | 9/1967 | Gray | 198/179 |
| 3,382,544 | 5/1968 | Moore | 19/202 |
| 3,399,518 | 9/1968 | Gray | 56/28 |
| 3,399,767 | 9/1968 | Rood, Jr. | 209/108 |
| 3,425,097 | 2/1969 | Rood, Jr. et al. | 19/203 |
| 3,467,991 | 9/1969 | Gray | 19/203 |
| 4,202,157 | 5/1980 | Rood, Jr. | 56/28 |
| 4,351,476 | 9/1982 | Rood, Jr. | 237/50 |
| 4,390,376 | 6/1983 | Rood, Jr. | 134/6 |

*Primary Examiner*—Louis K. Rimrodt
*Assistant Examiner*—J. Kravitz
*Attorney, Agent, or Firm*—Warren F. B. Lindsley

[57] ABSTRACT

An improved cotton cleaner incorporating a cleaning mechanism utilizing successive stages of saw-tooth drums and transverse bars. The physical orientation of individual cotton balls is controlled to assure exposure of at least two sides of each cotton ball to the cleaning action.

8 Claims, 6 Drawing Figures

GROUND COTTON RETRIEVER WITH DUAL CLEANING MEANS

BACKGROUND OF THE INVENTION

Modern mechanical cotton picking equipment has greatly reduced the cost of picking cotton and has provided a means for reliably and quickly picking cotton at the proper time. However, mechanical picking equipment has increased the amount of cotton that is knocked to the ground and which cannot be retrieved with ordinary picking equipment. The cotton that has been knocked to the ground is commonly called "down" cotton and was at one time considered lost to mechanical retrieving equipment.

DESCRIPTION OF THE PRIOR ART

Various machines have since been developed and put to use in the retrieval of "down" cotton. The state of the art for such machines is indicated by U.S. Pat. Nos. 3,217,878; 3,302,247; 3,305,898; 3,342,310; 3,382,544; 3,399,518; 3,399,767; 3,425,097; 3,467,991; 4,202,157; 4,351,476 and 4,390,376.

Most of the above referenced machines utilize transversely slotted retrieving belts. Various techniques are also disclosed in the patents for removing sticks, leaf trash and other debris picked up along with the "down" cotton by the cotton gleaners.

Of particular relevance to the present invention is a cleaning method that utilizes saw-tooth or peg-tooth drums and other means to move cotton and associated debris past a grid of transverse bars. As the cotton is brushed against the bars, the entangled debris tends to be knocked free and is thus removed from the cotton. This method of cleaning is referenced and described in U.S. Pat. Nos. 3,305,898; 3,382,544 and 3,467,991, referred to above.

A limitation of this cleaning method is that it tends to remove the debris from only one face of a ball of cotton, i.e., the face that happens to be exposed to the grid of transverse bars. In some cases, such as the machine of U.S. Pat. No. 3,305,898, successive cleaning operations are incorporated. Unfortunately, however, the orientation of the cotton is not controlled at successive stages and there is, therefore, no guarantee that more than one side of a retrieved down cotton ball is ever exposed to the cleaning action.

U.S. Pat. No. 3,382,544 discloses a cotton cleaner using grid bars and a rotating cotton carrier wherein the grid bars provide a moving surface to permit the cotton to be drawn past the grid bar without tearing the fibers of the cotton.

U.S. Pat. No. 3,467,991 discloses a cotton cleaner having a rotating saw that snags cotton tufts and carries the tufts around and upward on the saw teeth. The saw initially engages the cotton in such a manner that sticks and trash are forced in a tangential direction out of contact with the saw surface.

The effectiveness of such serially organized cleaning stages can clearly be improved if the physical orientation of each retrieved cotton ball can be controlled from stage to stage so that in one operation, the debris is removed from one face of the cotton ball, and at a succeeding stage, another face of the cotton ball is cleaned. The present invention utilizes such an approach to provide an improved cleaning operation.

SUMMARY OF THE INVENTION

In accordance with the invention claimed, an improved cotton gleaner or gin is provided incorporating a cleaning mechanism utilizing successive stages of saw-tooth gin drums to move retrieved down cotton balls past transverse bars for trash separation and controlling the orientation of the individual cotton balls to assure exposure of a different face of the cotton ball to the cleaning action of the bars at each stage.

It is, therefore, one object of the present invention to provide an improved cotton gleaner for use in the harvesting of "down" cotton;

Another object of this invention is to provide in such an improved cotton gleaner or gin means for more effectively removing sticks, leaf trash and other debris from retrieved down cotton balls; and .

A further object of this invention is to provide such an improved cleaning action through the utilization of saw-tooth gin drums in combination with transverse cleaning rods while controlling the orientation of the individual cotton balls at successive cleaning stages, thereby assuring that more than one face of each of the cotton balls is exposed to the cleaning action of the transverse bars.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described with reference to the accompanying drawings, in which.

DESCRIPTION OF THE PREFERRED EMBODIMENT

Figure 1:
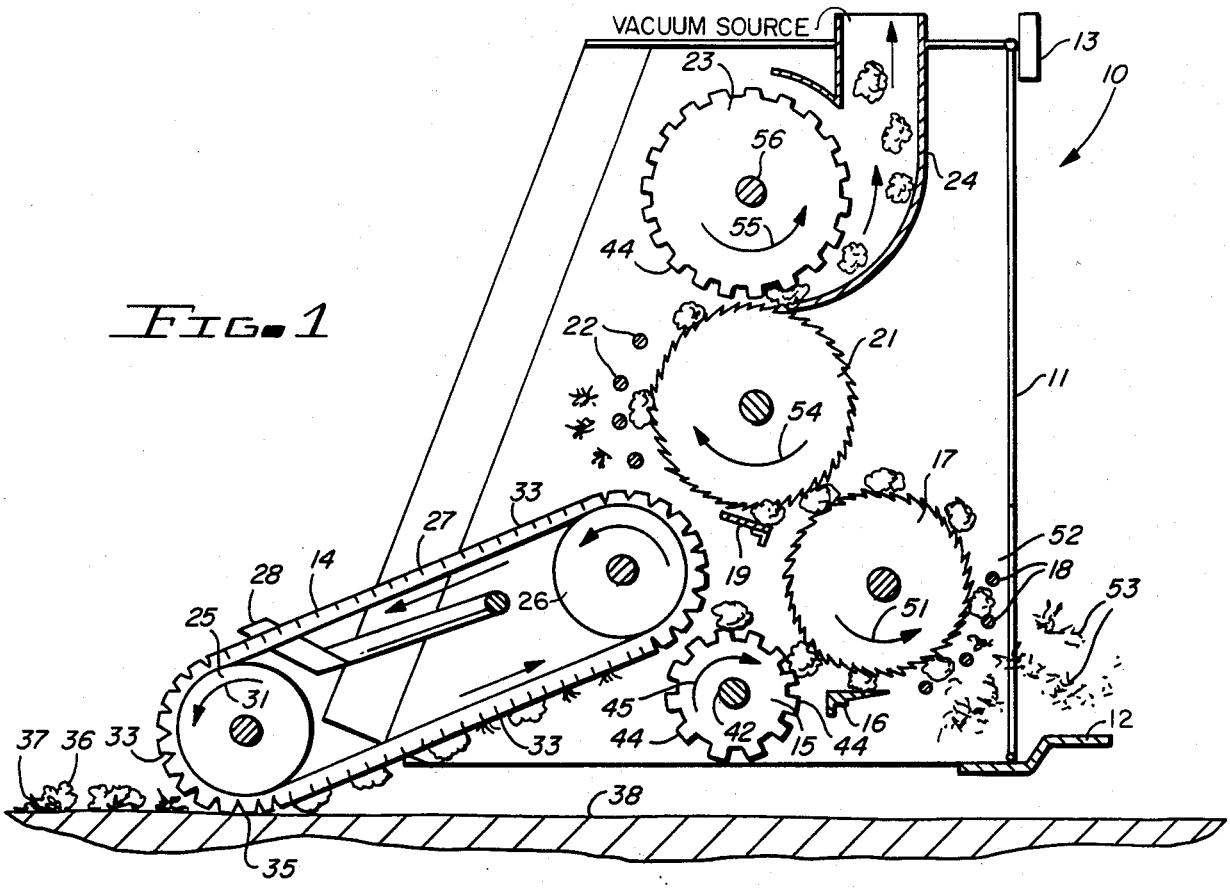
FIG. 1 is a diagrammatic representation of an improved cotton gleaner embodying the invention, the representation as shown approximating a cross-sectional side view of the gleaner.

Referring more particularly to the drawings by characters of reference, FIGS. 1–6 show an improved cotton gleaner 10 comprising an outer housing 11, mounting brackets 12 and 13 for securing the gleaner to the front of a cotton picker or stripper chassis (not shown), a slotted belt pick-up head 14, a first beater or transfer drum 15, a first baffle member 16, a first saw-tooth gin drum 17, a first means or grid of transverse cleaning rods 18, a second baffle member 19, a second saw-tooth drum 21, a second means or grid of transverse cleaning rods 22, a second beater or doffer drum 23 and a clean cotton removal conduit 24.

Figure 2:
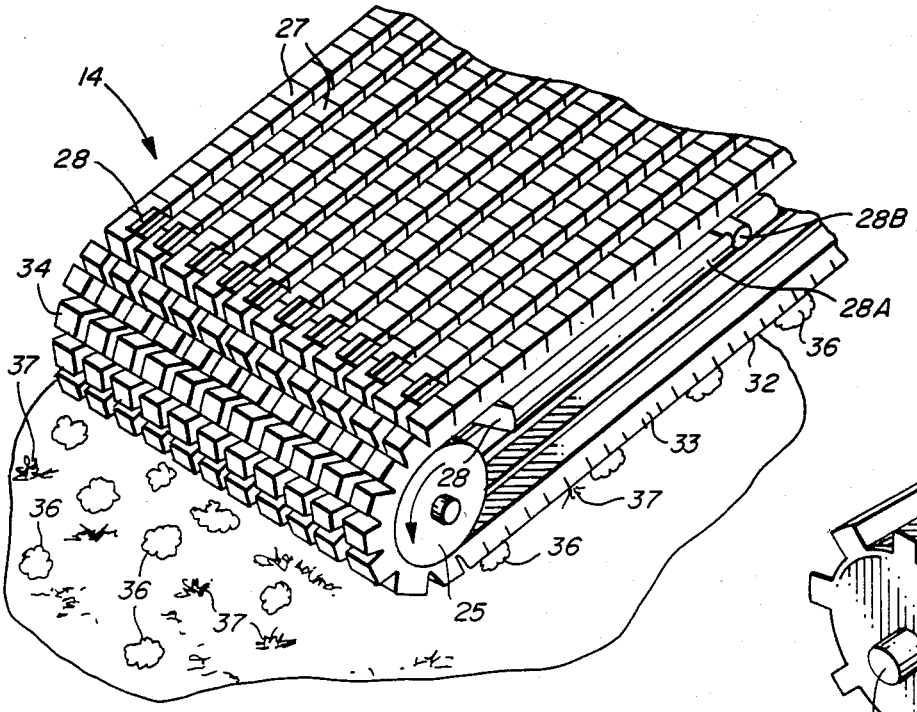
FIG. 2 is a partial perspective view of the slotted belt pick-up head utilized in the improved cotton gleaner.
Figure 3:
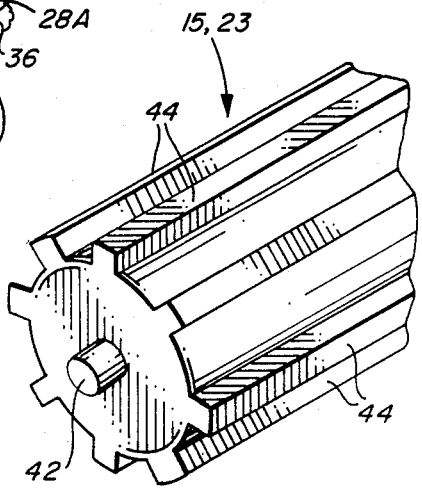
FIG. 3 is a partial perspective view of a transfer drum that is utilized as a working part of the gleaner.

The slotted belt pick-up head 14 is typical of those commonly employed in the referenced prior art. As shown in FIGS. 1 and 2, pick-up head 14 comprises two cylindrical drums or pulley systems 25 and 26 comprising what is known in the trade as banjo wheels and a multiplicity of slotted flexible belts 27. In the present invention, belt guide bars 28 which are attached through arms 28A to a cross bar 28B are incorporated to assure the proper positioning of the belts 27 on the forward pulley system 25. The belts 27 are slotted transversely to effect the pick-up action necessary for retrieving down cotton. In the operation of pick-up head 14, slotted belts 27 move in the direction indicated by arrows 29 as the drums or pulley systems 25 and 26 rotate in the direction of arrows 31. In the straight or unflexed portions 32 of belts 27, slots 33 are closed; in the flexed portions 34 of belts 27, slots 33 are open. The forward portion 35 of head 14, specifically forward pulley system 25, and the portions of belts 27, momentarily carried thereon, rest upon the surface of the field being gleaned. The drums or pulley systems 25 and 26, freely mounted on their respective axes, are thus caused to rotate in the indicated directions by the forward motion of the gleaner as it is propelled by the picker or stripper chassis' ground speed to which it is mounted by means of brackets 12 and 13. As head 14 thus moves forward, cotton tufts, clumps or balls 36 and debris 37 lying on ground 38 are wedged into the open slots 33. As slots 33 in belts 27 move rearward past the point of tangency with drum 25, they are closed as they reach the unflexed region 32 of the belts. During the closing of slots 33, the wedged cotton balls and assorted debris become firmly gripped within the closed slots and are carried rearward to drum or pulley system 26. As the slotted closed portion of belts 27 reach the flexed region beginning at the point of tangency with drum or pulley system 26, slots 33 are again opened to release the cotton and debris. Further detailed descriptions of the structure and operation of various versions of the slotted belt pick-up head may be found in the referenced prior art and are embodied herein by reference.

Belt guide bars 28 are secured to a structural member or rod 28B carried by housing 11. The individual bars 28 extend upward from frame member or arms 28A, one between each of the juxtapositioned belts 27, as shown in FIG. 2, and terminate just above the upper surface of the upper unflexed region of belts 27. In addition to guiding belts 27, the belt guide bars 28 maintain a given limited spacing, such as $\frac{1}{8}$ of an inch or greater between the various banjo wheels 25, thus eliminating excessive wear of the banjo wheels.

The transfer drum 15 comprises a cylindrical drum carried on an axle 42 and is provided with longitudinal ridges or paddles 44 uniformly spaced about its cylindrical surface to extend radially therefrom. These ridges or paddles 44 may be a rigid part of the drum or they may comprise flexible strips, such as rubber, secured to the drum's periphery. Alternatively, brush bristles may be substituted for the ridges or paddles 44.

Transfer drum 15 is positioned just rearward of and below the axis of drum or pulley system 26, with its axis aligned parallel therewith. Its outer surface is positioned in close proximity to the opening slots 33 of belts 27 as it passes over drum 26. Drum 15 is rotationally coupled to drums or pulley systems 25 and 26 by belts or chains, not shown in the drawing for clarity purposes, so that as drums or pulley systems 25 and 26 rotate in the direction of the arrows 31, transfer drum 15 is rotated in the direction of arrow 45. The ridges or paddles 44 thus beat against the cotton and debris carried by belts 27 in the region of the opening slots 33. This action of transfer drum 15 aids in the transferring of the cotton from belts 27 to drum 17. Drum 15 urges the loose cotton and debris in the direction of the first saw-tooth gin drum 17, which is axially aligned with drum 15 and positioned just rearwardly and vertically upwardly therefrom.

Figure 4:
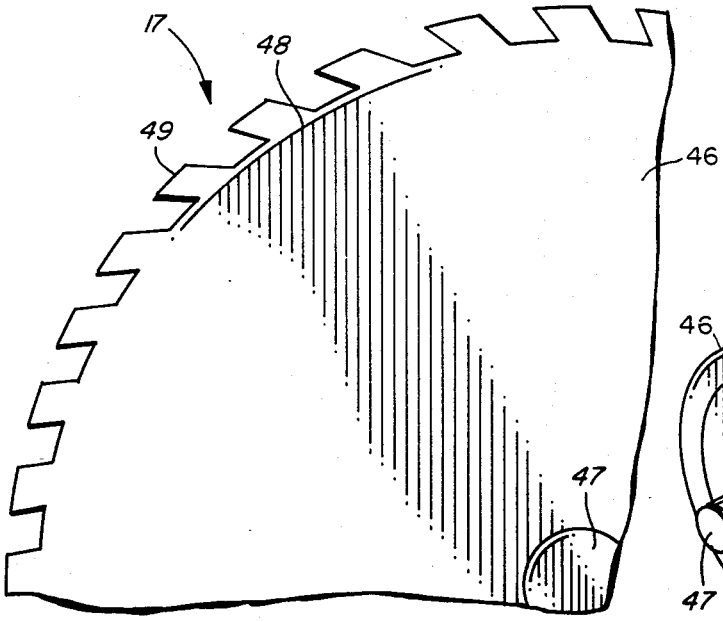
FIG. 4 is a cross-sectional view of a saw-tooth gin drum that is employed as a working part of the gleaner.
Figure 5:
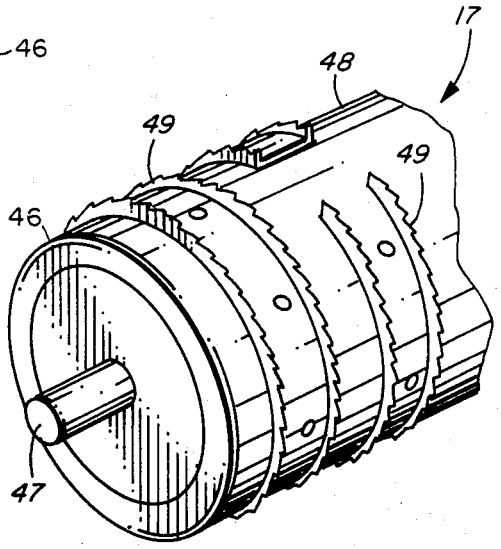
FIG. 5 is a partial perspective view of the saw-tooth gin drum.
Figure 6:
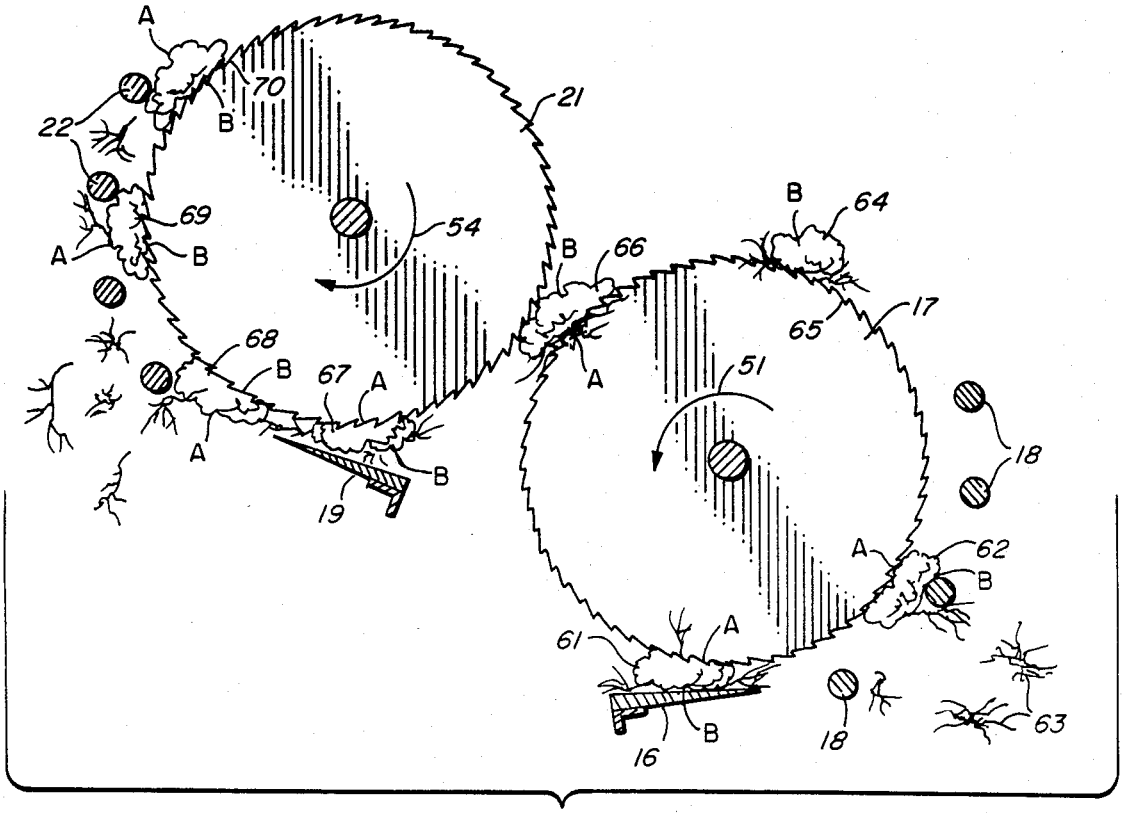
FIG. 6 is an enlargement of a critical portion of the representation of FIG. 1, the enlargement serving to illustrate the novel features of the invention.

As shown in FIGS. 4 and 5, saw-tooth gin drum 17 comprises a cylindrical drum 46 carried on an axle 47. Flexible metal strips 48 or channel gin saw-teeth 49 are secured to the surface of drum 46, being positioned thereon in encircling spirals. The edges of the strips are bent radially outward and saw-teeth 49 are exposed at the extending edges thereof, as most clearly indicated in FIG. 4. Drum 17 is coupled by belts or chains, not shown, to drums 15, 21 and 17 and rotates in the direction of arrows 45, 51 and 54 as shown in FIG. 6.

Rectangular baffle means 16, preferably of a flexible material, such as rubber, has its longitudinal axis aligned with the axis of drum 17 with its surface tangent with a circle just larger than the diameter of drum 17. It is positioned to form a tapered channel with the outer surface of drum 17, which channel directs the cotton and debris being directed thereto by transfer drum 15 toward teeth 49 of drum 17. Baffle means 16's purpose is to set the cotton into the channel saw teeth. As the cotton thus becomes confined between moving teeth 49 of drum 17 and baffle means 16, the cotton is snagged by teeth 49 for movement around drum 17.

The cotton balls, thus securely gripped by saw-tooth gin drum 17, are carried in the direction of arrow 51 toward a grid of transversely positioned cleaning rods 18 which are evenly spaced about the arc of a circle 52 that has a diameter somewhat larger than that of drum 17. Cleaning rods 18 are positioned sufficiently close to the outer surface of drum 17 such that the cotton balls carried by drum 17 are whipped and brushed briskly against rods 18. Twigs, grass, leaf trash and other debris 53 attached to or extending from the outer surface of the individual cotton balls are broken loose and are carried by centrifugal forces outwardly through the spaces between rods 18.

The second saw-tooth gin drum 21 is of a construction similar to that of drum 17 and is positioned just above and just forward of drum 17. The axis of drum 21 is parallel with the axis of drum 17 and the periphery of drum 21 is sufficiently near that of drum 17 such that a typical cotton ball carried by drum 17 must be significantly compressed to pass between the toothed surfaces of the two drums. Drum 21 is coupled to drums 15 and 17 by belts or chains, not shown, and is driven rotationally in the direction of arrow 54. The outer surfaces of drums 17 and 21 are seen to move in the same direction in the region of their nearest proximity. Drum 21's RPM is sufficiently greater to "hook" the cotton from drum 17 and "set" into teeth 49 by baffle means 19.

The baffle means 19 is positioned just downstream of this region of proximity. The longitudinal axis of baffle means 19 is aligned with the axis of drum 21. Its surface is tangent with a circle drawn about drum 21 at a diameter just larger than that of drum 21 so that a tapered channel is formed by baffle means 19 that urges any cotton balls that may be caught therein toward more intimate contact with the teeth of drum 21.

Drum 21 is caused by virtue of the design of its coupling means to rotate at a peripheral velocity greater than that of drum 17: The ratio of the peripheral velocity of drum 21 to that of drum 17 is preferably in the order of two-to-one. Because the peripheral velocity of drum 21 is greater than that of drum 17, the cotton balls that are carried by drum 17 into the confined region of closest proximity between the two drums are snagged by the teeth of drum 21; they are then moved forward at a velocity greater than the peripheral velocity of drum 17 and are thus dislodged from the forwardly directed teeth of drum 17. Immediately thereafter, the cotton balls that have been snagged by the teeth of drum 21 are urged more firmly against the toothed surface of drum 21 by baffle means 19 so that a secure hold on the cotton balls by drum 21 is effectively assured.

The second grid of cleaning rods 22 is uniformly distributed about an arc of a circle centered on the axis of drum 21 at a radius just larger than the outer diameter of drum 21. The cleaning rods 22 are located just downstream of baffle means 19 so that the cotton balls carried past baffle means 19 immediately enter another relatively confined passage lying between the periphery of drum 21 and the grid of cleaning rods 22. Debris attached to and extending from the outer surface of the cotton balls held by the teeth of drum 21 is dislodged by violent rubbing contact with rods 22 and is carried by centrifugal force radially outwardly through the openings between these rods.

Doffer drum 23 is coupled to drum 21 and rotates in the direction of arrow 55 about an axis 56 that is parallel with the axis of drum 21. The peripheral velocity of drum 23 is substantially greater than that of drum 21 and its extending ridges or paddles 44 closely approach the surface of drum 21 striking the cotton balls carried by the teeth of drum 21, thereby dislodging them and driving them upwardly through conduit 24 toward a collection bin. Doffer drum 23 might advantageously incorporate in its design the characteristics of a paddle blower, this added functionality being useful in establishing an airstream for the transportation of the cleaned cotton through conduit 24. For this purpose, an open construction will be required rather than the closed construction suggested by FIG. 3. If desired, conduit 24 may be connected to a vacuum source for drawing the cotton outwardly through the conduit to a collection bin.

The foregoing description of the construction and operation of gleaner 10 has not dealt with the chief element of novelty, i.e., the manner in which the arrangement of the various elements assures the thorough cleaning of the cotton balls. This feature is most clearly set forth with reference to FIG. 6. FIG. 6 shows the two saw-tooth gin drums 17 and 21, the associated baffle means 16 and 19, and the two grids of cleaning rods 18 and 22. These are the same elements as those shown in FIG. 1 with corresponding reference characters.

Cotton balls 61 entering between baffle means 16 and the periphery of drum 17 are snagged by the teeth of drum 17. At this point, twigs, trash and other debris extend from all sides of the cotton ball including side A that is snagged by the teeth of drum 17 and side B which is shown on the outside of the cotton ball which brushes against baffle means 16.

When the cotton ball 62 reaches cleaning bars 18, it still carries debris on both of its faces A and B. Trash 63, at this point, is dislodged and discharged from its side B by bars 18.

Cotton ball 64 emerges from grid 18 with its outer face B cleared of debris, but debris 65 still extends on and from its side A which is secured to drum 17.

Cotton ball 66 has its uncleaned side A still attached to drum 17. Its opposite side B which has been cleaned by grid 18 is now being snagged by the teeth of drum 21. As drum 21 thus captures ball 66, the uncleaned side A becomes the outside of cotton ball 66 relative to its attachment to drum 21.

Cotton balls 67–70 having been captured in the same manner by drum 21 also have their previously cleaned inner surfaces B attached to the teeth of drum 21 while their uncleaned surfaces A are now subjected to the cleaning action of grid 22.

Side B of each cotton ball is thus seen to be cleaned at grid 18 while side A is cleaned at grid 22. The thorough cleaning action defined as a major object of the invention is thus achieved and is made possible through the controlled orientation of the individual cotton balls during their passage through the two successive cleaning stages.

Although but a single embodiment of the invention has been illustrated and described, it will be apparent to those skilled in the art that various changes and modifications may be made therein without departing from the spirit of the invention or from the scope of the appended claims.

What is claimed is:

1. An apparatus for removing dirt and debris from clumps of cotton, said apparatus comprising in combination:

a first rotatable transfer means positioned for catching clumps of cotton from a source, a first saw-tooth drum means having saw-teeth on its outer surface mounted for rotation about a first axis, a second saw-tooth drum means having saw-teeth on its outer surface mounted for rotation about a second axis, said first and second axes positioned relative to each other to define a feed space between the peripheries of said first and second drum means for receiving clumps of cotton, said first and second drum means rotating about their respective axes with the peripheral velocity of said first drum means being less than and in the same direction as the peripheral velocity of said second drum means to enable the saw-teeth of said second drum means to engage in said feed space said clumps of cotton held by the saw-teeth of said first drum means and to carry said clumps of cotton away from said feed space, a first grid means fixedly positioned to extend in an arcuate configuration adjacent the surface of said first drum means at a point spaced therefrom, a second grid means fixedly positioned to extend in an arcuate configuration adjacent the surface of said second drum means at a point spaced therefrom, the saw-teeth of said first drum means upon rotation of said first drum means holding said clumps of cotton and rubbing an exposed first surface thereof over said first grid means for cleaning thereof, the saw-teeth of said second drum means upon rotation of said second drum means grasping in said feed space the cleaned first surface of said clumps of cotton held by the saw-teeth of said first drum means, thereby exposing a second surface of said clumps of cotton and sequentially, while holding onto said clumps of cotton, rubbing the exposed second surfaces of said clumps of cotton over said second grid means for cleaning thereof, a doffing means rotatably positioned for removing the clumps of cotton cleaned by said second grid means from the saw-teeth of said second drum means, and means for forcing the cleaned clumps of cotton from said doffing means into a cotton removal conduit.

2. An apparatus for removing dirt and debris from clumps of cotton that are released from the slots of a group of retrieving belts as the belts pass around a rotating pulley means that causes the slots to open, said apparatus comprising in combination:

a first rotatable transfer means positioned for catching the released clumps of cotton from a portion of said belts passing around said pulley means, a first saw-tooth drum means having saw-teeth on its outer surface mounted for rotation about a first axis, a second saw-tooth drum means having saw-teeth on its outer surface mounted for rotation about a second axis, said first and second axes positioned relative to each other to define a feed space between the peripheries of said first and second drum means for receiving clumps of cotton, said first and second drum means rotating about their respective axes with the peripheral velocity of said first drum means being less than and in the same direction as the peripheral velocity of said second drum means to enable the saw-teeth of said second drum means to engage in said feed space said clumps of cotton held by the saw-teeth of said first drum means and to carry said clumps of cotton away from said feed space, a first grid means fixedly positioned to extend in an arcuate configuration adjacent the surface of said first drum means at a point spaced therefrom, a second grid means fixedly positioned to extend in an arcuate configuration adjacent the surface of said second drum means at a point spaced therefrom, the saw-teeth of said first drum means upon rotation of said first drum means holding said clumps of cotton and rubbing an exposed first surface thereof over said first grid means for cleaning thereof, the saw teeth of said second drum means upon rotation of said second drum means grasping in said feed space the cleaned first surface of said clumps of cotton held by the saw-teeth of said first drum means, thereby exposing a second surface of said clumps of cotton and sequentially, while holding onto said clumps of cotton, rubbing the exposed second surfaces of said clumps of cotton over said second grid means for cleaning thereof, a doffing means rotatably positioned for removing the clumps of cotton cleaned by said second grid means from said second drum means and forcing the cleaned clumps of cotton into a removal conduit.

3. The apparatus set forth in claim 2 wherein:

said first and second grid means each comprise a plurality of spaced bars extending parallel with the axis of the associated drum means.

4. The apparatus set forth in claim 2 wherein:

said doffing means comprises a blower function.

5. The apparatus set forth in claim 2 in further combination with:

a first baffle means mounted adjacent said first drum means at a position adjacent to the point of movement of said clumps of cotton across said first grid means for causing said clumps of cotton to snag more firmly on the teeth of said first drum means.

6. The apparatus set forth in claim 5 in further combination with:

a second baffle means mounted adjacent said second drum means at a position adjacent to the point of movement of said clumps of cotton across said second grid means for causing said clumps of cotton to snag more firmly on the teeth of said second drum means.

7. The apparatus set forth in claim 2 in further combination with:

a plurality of guide bars, one mounted between each of the retrieving belts to maintain separation and rubbing between the belts.

8. The apparatus set forth in claim 2 in further combination with:

a housing with said first transfer means, said first drum means, said second drum means, and said doffing means being arranged in that sequence in a vertical array from the bottom to top of said housing and with their axes arranged parallel to each other.

* * * * *